US005107798A

United States Patent [19]

Gerep

[11] Patent Number: 5,107,798

[45] Date of Patent: Apr. 28, 1992

[54] COMPOSITE STUDS, PULP MILL RECOVERY BOILER INCLUDING COMPOSITE STUDS AND METHOD FOR PROTECTING BOILER TUBES

[75] Inventor: Marcio Gerep, Rio de Janiero, Brazil

[73] Assignee: Sage of America Co., Collegedale, Tenn.

[21] Appl. No.: 682,143

[22] Filed: Apr. 8, 1991

[51] Int. Cl.[5] ..... F22B 37/00

[52] U.S. Cl. ..... 122/6 A; 122/7 R; 165/134.1; 165/171; 165/181

[58] Field of Search ..... 119/238; 122/7 R, 6 A, 122/367.1; 165/171, 181, 134.1

[56] References Cited

U.S. PATENT DOCUMENTS

| | | | |
|---|---|---|---|
| 2,077,410 | 4/1937 | Harter et al. | 122/6 A |
| 2,239,662 | 4/1941 | Bailey | 122/6 A |
| 2,325,945 | 1/1942 | Fuchs | 122/367.1 |
| 2,402,659 | 2/1943 | Nelson | 219/98 |
| 2,711,798 | 3/1950 | Aversten | 219/98 |
| 2,993,982 | 10/1959 | Glover | 219/98 |
| 3,476,180 | 6/1967 | Straight, Jr. et al. | 122/367.1 |
| 3,760,143 | 9/1973 | Rondeau et al. | 219/99 |
| 3,993,887 | 11/1976 | Richards | 219/99 |
| 4,410,783 | 10/1983 | Pease et al. | 219/98 |
| 4,424,434 | 1/1984 | Pease et al. | 219/99 |
| 4,554,967 | 11/1985 | Johnson et al. | 122/367.1 |
| 4,635,713 | 1/1987 | Johnson et al. | 122/367.1 |
| 4,638,858 | 1/1987 | Chu | 165/181 |

OTHER PUBLICATIONS

J. A. Dickinson, M. E. Murphy, W. C. Wolfe (Babcock & Wilcox), "Kraft Recovery Boiler Furnace Corrosion Protection", technical paper presented to TAPPi Engineering Conference, Atlanta, Ga., Sep. 28-Oct. 1, 1981.

*Primary Examiner*—Henry C. Yuen
*Attorney, Agent, or Firm*—Steven C. Schnedler

[57] ABSTRACT

Boiler tube studs of composite construction, particularly for protecting waterwall tubes in pulp mill recovery boilers. The studs include an inner solid cylindrical core of a material having thermal conductivity sufficient to provide proper heat transfer to the boiler tubes during operation, and an outer cylindrical sleeve of a material resistant to destructive conditions within a boiler during operation, such as chemical attack and abrasion. The sleeve surrounds the cylindrical surface of the core, but leaves an end surface of the core exposed. The core may be made of low carbon steel, and the sleeve of stainless steel. In order to avoid melting of the stainless steel sleeves when the studs are welded to the tubes, the cylindrical sleeves do not extend all the way to the attachment end such that axial gaps are defined where the sleeves do not cover the cylindrical surfaces of the cores. Compared to standard carbon steel studs, the composite studs have a much longer life before replacement is required, and yet they wear sufficiently for wear patterns to be observed as an indicator of boiler operating conditions. The composite studs maintain a cylindrical configuration as they wear, resulting in improved anchoring of a frozen smelt layer and thus protection of the boiler tubes compared to conventional studs. The composite studs are compatible with conventional studs, in the context of either studs replacement, or replacement of tubes or groups of tubes in panels, and methods of use are disclosed.

28 Claims, 3 Drawing Sheets

COMPOSITE STUDS, PULP MILL RECOVERY BOILER INCLUDING COMPOSITE STUDS AND METHOD FOR PROTECTING BOILER TUBES

BACKGROUND OF THE INVENTION

The present invention relates generally to boilers, such as pulp mill recovery boilers and, more particularly, to studs welded to water-carrying heat-exchange tubes of such boilers for heat exchange and protective purposes.

In a pulp mill where paper is made, wood chips processed from debarked logs are cooked in a soda solution in a high pressure vessel known as a digester. The soda solution at high temperature and pressure dissolves resins (lignin) binding cellulose fibers in the wood chips. The cellulose fibers are separated, washed, bleached and further processed to manufacture paper, or for other applications.

After cellulose fiber separation, what is left is an aqueous solution The aqueous solution is concentrated by evaporation to a concentration of approximately one-third water. The rest is combustible resin (lignin) and chemicals which can be recovered. Up to 98% of the chemicals used in the process can be recovered. Moreover, the resins constitute an excellent fuel.

Universal practice is to thus concentrate the solution by evaporation and make various chemical adjustments to form what is known as black liquor, and then to burn the black liquor as fuel in a recovery boiler. A recovery boiler is a large structure, perhaps fifteen stories high, and thirty to forty feet (9.1 to 12.2 meters) wide. The lower portion of a recovery boiler where combustion occurs is known as the furnace, and is the hottest part The walls of a recovery boiler are waterwalls formed of water-carrying tubes which are heated by the combustion process to usefully generate steam.

Within the recovery boiler, the resins constituting part of the black liquor are burned to produce heat and waste gases, while the chemicals such as soda form a molten residue known as smelt, which is recovered.

Advantages of this process are that burning the resin part of the black liquor as fuel generates steam which typically provides more than half of a mill's energy requirements, and that nearly all of the chemicals used in the process of cooking wood chips are recovered in the form of the smelt. Also, processing the black liquor in a recovery boiler in this manner solves what otherwise would be a serious environmental concern in disposing of the aqueous solution which remains after cellulose fiber separation.

A complicating factor in this process is that the smelt temperature is approximately 2100° F. (1149° C.). The smelt and gases within the recovery boiler are chemically highly active at these temperatures. Also, during boiler operation, the black liquor is typically sprayed from a number of nozzles directly against the walls of the lower, furnace portion of the boiler. Thus, the carbon steel water-carrying tubes are subject to corrosion and eventual destruction, which would necessitate extremely expensive rebuilding of the boiler. Moreover, failure of the water-carrying tubes is potentially catastrophic as an explosion can occur if water within the tubes comes into contact with the 2100° F. (1149° C.) smelt. This corrosion process is described in detail in a technical paper by J. A. Dickinson, M.E. Murphy and W. C. Wolfe (Babcock & Wilcox) entitled "Kraft Recovery Boiler Furnace Corrosion Protection", presented to TAPPI Engineering Conference, Atlanta, Ga., Sept. 28 through Oct. 1, 1981.

A common practice in recovery boilers, particularly in the furnace portion, is to employ for corrosion protection a multiplicity of cylindrical studs, analogous to heat-exchange fins. Each stud has a base or attachment end welded to the external surface of a water-carrying tube, and an exposed or tip end projecting radially outward from the tube. Conventional studs are made of low carbon steel and, when new, are typically 3/8 inch (0.95 cm) or ½ inch (1.27 cm) in diameter, and ¾ inch (1.91 cm) in length. Studs typically are applied at a density of ninety studs per lineal foot (30.5 cm) of three-inch (7.62 cm) diameter water-carrying tube. A recovery boiler may have anywhere from 100,000 to 1,000,000 studs in total. The Dickinson et al paper referenced above analyzes the effects of various stud diameters, arrangements and densities.

The studs serve a number of important functions. One function is to aid heat exchange in the manner of heat-exchange fins between the 2100° F. (1149° C.) smelt and the outer walls of the water-carrying tubes, which typically have a temperature in the range of approximately 550° F. (288° C.) to 600° F. (316° C.). Closely related to the heat-exchange purpose, another purpose of the studs is to promote rapid cooling of the molten smelt, which solidifies to form what is known as a frozen smelt layer. The frozen smelt layer advantageously serves as a refractory layer preventing direct contact between the hot smelt and the metal walls of the water-carrying tubes. The frozen smelt layer minimizes the amount of corrosive gases penetrating to the tube surface, and provides a thermal insulating effect. The studs thus can become partially or entirely embedded in the frozen smelt layer, with heat transfer occurring in large part through the tips of the studs. The studs may be viewed as an interface which prevents direct contact between the hot smelt and the surface of the tubes.

During boiler operation, the black liquor is sprayed towards the walls and burned, transforming the organic fractions of the black liquor into exhaust gases, while the inorganic fractions melt and flow downward, accumulating in the furnace bottom, and flowing away through spouts into a dissolving tank. Combustion normally starts as black liquor is atomized and emerges as droplets from a nozzle, which droplets travel within the furnace towards the walls. Once the droplets reach the walls, combustion is essentially complete, and the smelt accumulates among the studs. If the cooling conditions are sufficient, some of the smelt stabilizes forming the frozen smelt layer. The process is continuous and dynamic; thus, the frozen smelt layer frequently falls away as a paste, momentarily exposing the surface of the carbon steel water-carrying tubes. The tubes are then immediately recoated with a new smelt layer, which becomes a frozen smelt layer when properly cooled down.

Another significant function of the studs related to this process is an anchoring effect, which promotes the building up and maintenance of the frozen smelt layer to protect the water-carrying tubes.

Even while completely or partially embedded in the frozen smelt layer, the studs continue to transfer heat. Inside the frozen smelt layer, the temperature is much lower than the 2100° F. (1149° C.) smelt temperature, reducing the corrosion rate of the carbon steel boiler tubes.

A characteristic of these studs, which has both advantages and disadvantages, is that they are sacrificial bodies and are consumed during operation. One disadvantage is that the studs are less able to satisfy their above-discussed purposes as they are gradually consumed, and eventually must be replaced, with attendant cost in terms of both direct replacement expense and mill downtime. Consumption of the studs presents a significant threat to boiler safety, since the capability of providing a frozen smelt layer no longer exists if the studs are completely consumed. Studs are replaced when they have worn from their original ¾ inch (1.91 cm) length to ¼ or 3/16 inch (0.64 or 0.48 cm). Typically they are consumed within one to two years. Replacement studs are directly attached to nubbins of worn studs by electric arc welding. A variety of specific welding techniques are employed, involving for example gas protection or a ceramic ring. Studs can be replaced at a rate of 50,000 to 100,000 per day. Sometimes, as many as 250,000 studs are replaced at a time.

Another disadvantage relates to the fact that conventional studs do not maintain a cylindrical shape as they wear. Rather, they assume a conical shape as the circular edge at the end of each cylindrical stud receives heat input at a relatively higher rate than it can be conducted through the stud. Thermal analysis can demonstrate that the circular edge is at a higher temperature than the rest of the stud, which causes a relatively rapid collapse of the edge as the stud assumes the conical or rounded shape. Temperature varies in the axial direction along each stud, with the stud base (attached to the tube) having the lowest temperature, close to the temperature of the tube wall itself. The new profile eventually stabilizes as heat flow reaches a balance between incoming heat and transferred heat. This rounded or conical profile is not as effective as a conical, flat-tipped stud in anchoring the frozen smelt layer. Thus, the studs become less effective in anchoring the frozen smelt layer than they otherwise would be.

A particularly significant advantage of the sacrificial nature of the studs is that the wear patterns of the studs provide valuable information regarding combustion conditions within the recovery boiler. It is a major engineering challenge to spray the fuel (black liquor) evenly within the furnace for even heating. Moreover, unevenness in heating is caused by the manner in which combustion air is introduced into the furnace. Other variable factors include water flow conditions in general, and internal depositions within the tubes. As a result, "hot spots" are common in boilers, which require careful monitoring inasmuch as the premature failure of even one tube could have disastrous consequences. Thus, the wear patterns of the studs at different points within the boiler is normally closely observed at periodic intervals both to maintain proper operating conditions, and to determine the need for preventative maintenance.

Another advantage of the sacrificial nature of the studs is that the sacrificial wearing of the studs tends to limit the wear on the water-carrying tubes, since these water-carrying tubes are not directly exposed to the 2100° F. (1149° C.) smelt temperature.

A different prior art approach to protecting water-carrying tubes in a recovery boiler is to employ unstudded composite tubes. Composite water-carrying tubes are made of two different materials, extruded together. The external part is made of stainless steel, which protects the inner portion, made of low carbon steel. Direct contact between the inner carbon steel tube and the smelt is accordingly prevented. In principle, if the tube skin is able to withstand the chemical attack of the smelt, then studs are not necessary. There is a potential for relatively long life. (Since stainless steel has four times the thermal resistance of carbon steel, it is unlikely that an all stainless steel tube thick enough for structural soundness would have sufficient heat transfer capability. Accordingly, a relatively thin stainless steel skin is provided over the carbon steel tube.)

Composite tubes, however, have their own disadvantages. A significant disadvantage is that the composite tubes do not wear in a manner which clearly indicates "hot spots" in a boiler which, as discussed above, result from variable factors such as fuel distribution, air distribution, water flow conditions, internal deposition inside the tubes, as well as other factors. Closely related to this, there is no warning whatsoever should the protective stainless steel skin become locally worn away, exposing the carbon steel inner tube portion. Catastrophic failure can accordingly occur with no warning.

Also, the replacement of carbon steel tubes with composite tubes is an extremely expensive process, with an attendant lengthy downtime. Similarly, repairing a composite tube is difficult.

While the foregoing discussion has been in the context of studs for tubes in pulp mill recovery boilers, it will be appreciated that related (but not necessarily identical) considerations apply in the case of other boiler applications. While a pulp mill recovery boiler is a particularly corrosive environment, other adverse situations include abrasive environments. For example, waste disposal incinerators can be of similar construction, and in such incinerators abrasive particles and various solid materials may be directed towards the water tubes. Other examples are oil- or coal-fueled cyclone boilers for power generation, and various types of furnaces used in industrial processes.

SUMMARY OF THE INVENTION

Accordingly, it is an object of the invention to provide improved protection for water tubes in pulp mill recovery boilers.

It is a related object of the invention to provide such improved protection which is compatible with the conventional use of studs applied to carbon steel water tubes.

It is yet another object of the invention to provide an improved boiler tube stud for pulp mill recovery boilers and other applications.

Briefly, and in accordance with an overall aspect of the invention, a boiler tube stud of composite construction combining two materials is provided. The two materials have differing yet complementary properties.

To provide proper heat transfer to the walls of the boiler tube for the various purposes detailed hereinabove, a solid cylindrical core of a material having sufficient heat transfer is provided. Presently preferred as composite stud core material in the specific environment of a recovery boiler is low carbon steel, such as conventional studs are entirely made of. However, other heat-conductive core materials may be employed in particular applications, such as copper. Physically, the stud core has a cylindrical surface, an exposed tip or end surface through which heat transfer typically primarily occurs, and a base or attachment end.

For enduring the severe environmental conditions within the boiler and protecting the core, a cylindrical sleeve of a material resistant to destructive conditions within the boiler during operation is provided, and surrounds the cylindrical surface portion of the core, while leaving the tip or end surface of the core exposed. In the context of a recovery boiler, the term "resistant to destructive conditions" primarily refers to chemical attack by the molten smelt and related gases at the high temperatures that are present as discussed hereinabove. It will be appreciated, however, that in other applications the term "resistant to destructive conditions" may refer to abrasive or other mechanical attack, possibly in combination with chemical attack. Presently preferred as composite stud sleeve material in the specific environment of a recovery boiler is stainless steel. However, a variety of other materials are potentially suitable in this and other applications, including niobium and titanium, or any other suitable material.

The composite construction is advantageous and synergistic. Thus, for example, while low carbon steel has sufficient thermal conductivity, its wear characteristics in the corrosive environment of a recovery boiler leave much to be desired, as is discussed hereinabove. On the other hand, the material resistant to destructive conditions, for example stainless steel, has insufficient thermal conductivity to provide proper heat transfer. To provide a specific example, the thermal conductivity of stainless steel is only one-fourth that of low carbon steel.

In accordance with another aspect of the invention, in order to avoid melting of the sleeve material when the stud is welded to the boiler tube, preferably the cylindrical sleeve does not extend all the way to the attachment end such that an axial gap is defined where the sleeve does not cover the cylindrical surface of the core. An alloy having unpredictable characteristics, possibly brittle, might otherwise be formed.

As specific examples, for a stud approximately 3/8 inch (0.95 cm) to ½ inch (1.27 cm) in diameter, and ¾ inch (1.91 cm) in length, the sleeve has a thickness of approximately 0.02 inch (0.5 mm). As one example, the core is made of low carbon steel specified as ASTM 1010 to 1020 and the cylindrical sleeve is of stainless steel specified as AISI 304.

In accordance with another aspect of the invention, there is provided an improved recovery boiler for burning black liquor in a pulp mill. The boiler includes an enclosure having walls comprising carbon steel water-carrying tubes for generating steam. The enclosure in turn includes a lower furnace portion where combustion occurs. The boiler includes means such as spray nozzles for introducing black liquor into the furnace portion for combustion to form waste gases and smelt. A plurality of studs are attached to the water-carrying tubes for anchoring a frozen smelt layer to protect the water-carrying tubes from direct contact with molten smelt and for accommodating a temperature differential between the molten smelt and the water-carrying tubes. At least some of the studs are of composite construction and include a solid cylindrical core of a material such as, but not limited to, carbon steel, having thermal conductivity sufficient to provide proper heat transfer to the boiler tubes during operation; and a cylindrical sleeve of a material such as, but not limited to, stainless steel resistant to destructive conditions within the boiler during operation surrounding the cylindrical core.

In accordance with yet another aspect of the invention, there is provided a method for protecting carbon steel boiler tubes in a recovery boiler. The method includes the steps of providing a plurality of studs of composite construction as described above, and then welding the attachment ends of the composite studs to the boiler tubes. In the case of a recovery boiler having a plurality of worn conventional steel studs, the attachment ends of the composite studs may be welded to at least some of the worn studs. Thus either all or less than all of the worn conventional carbon steel studs can be replaced. A recovery boiler with a mix of conventional carbon steel studs and composite studs can result.

The composite studs of the invention combine the beneficial effects of conventional carbon steel studs with the potential long-life advantage of the composite tube approach. While the composite studs of the invention do wear, they wear at a much slower rate. Thus, rather than being completely consumed within one or two years as in the case of conventional studs, the composite studs last at least four years. Thus, the cost of periodic replacement is incurred much less frequently. Moreover, since the composite studs of the invention do exhibit some wear, they continue to provide valuable information regarding operating conditions within the boiler.

Another significant advantage of the composite studs of the invention is that their cylindrical shape is maintained as the studs wear, rather than assuming a conical shape. Thus, even as the studs wear, they remain far more effective than conventional studs in anchoring the frozen smelt layer, resulting in a thicker and more effective frozen smelt layer over the lifetime of the studs.

Yet another advantage of the invention is that the composite studs are entirely compatible with conventional carbon steel studs. They may be installed with the same welding equipment. A mixture of composite studs and conventional studs may be employed in the same boiler. Thus, within a given recovery boiler, the conventional studs can be replaced on a section-by-section basis as part of a normal maintenance cycle. A transition to composite studs can be approached in a gradual manner, with attention given to the more critical spots within the boiler first. This is in sharp contrast to the effort that would be required to retrofit a boiler with composite tubes, with an attendant relatively lengthy boiler shutdown.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description, taken in conjunction with the drawings, in which:

DETAILED DESCRIPTION

Figure 1:
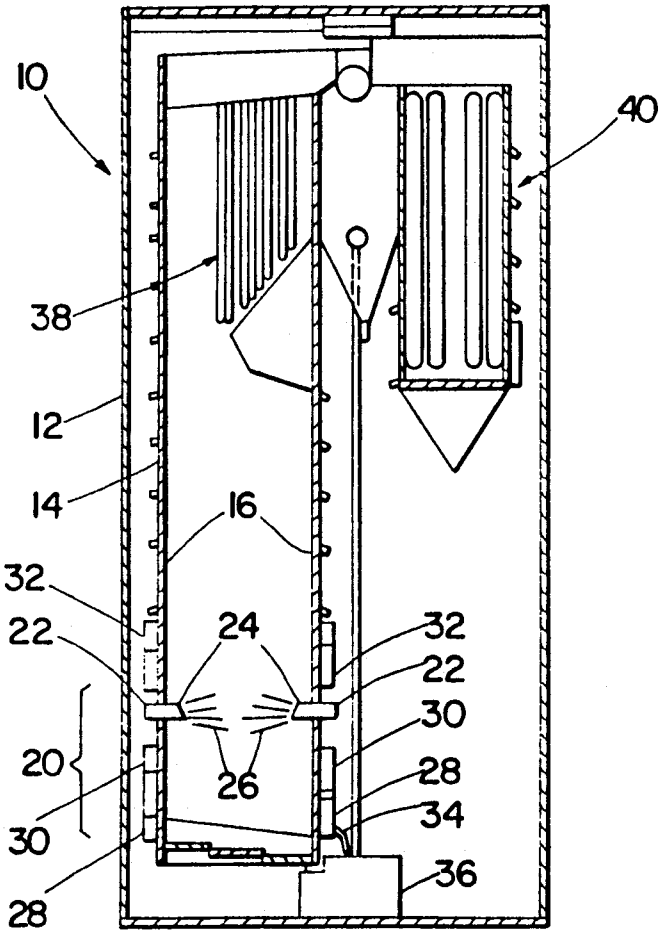
FIG. 1 depicts a typical recovery boiler in a pulp mill.

Referring first to FIG. 1, shown in cross-section is a typical recovery boiler 10 for burning black liquor in a pulp mill. The recovery boiler 10 includes an outer enclosure 12 and an inner enclosure 14 having walls 16 comprising carbon steel water-carrying tubes 18 (FIG. 2) for limiting enclosure temperature and for generating steam. The inner enclosure 14 includes a lower furnace portion, generally designated 20, where combustion primarily occurs.

Black liquor employed as the fuel in the recovery boiler 10 is delivered from a source (not shown) under pressure through conduits 22 and spray nozzles 24 into the interior of the furnace portion 20. Sprays comprising droplets of black liquor are represented at 26. Combustion air is introduced into the boiler 10 as primary air and secondary air entering the furnace portion 20 through respective manifolds 28 and 30, and as tertiary air introduced just above the furnace portion 20 through a manifold 32.

During operation, black liquor is sprayed generally towards the inner enclosure 14 walls 16, particularly the walls of the furnace portion 20, and burned. This transforms the organic fractions of the black liquor into exhaust gases which travel upward. Combustion starts as the black liquor is atomized as droplets comprising the sprays 26 upon emerging from the nozzles 24, and combustion of each individual droplet is normally complete by the time the droplet reaches a wall. Inorganic fractions of the black liquor melt to form smelt which flows downward to accumulate in the furnace bottom and flows away through spouts 34 into a dissolving tank 36.

The upper portions of the recovery boiler 10 comprise conventional flue structures and heat exchangers for extracting energy from the combustion exhaust gases to produce superheated steam. Thus, represented in FIG. 1 is a bank of heat exchange tubes comprising a generator section 38, and a bank of heat exchange tubes comprising a preheat section 40.

Figure 2:
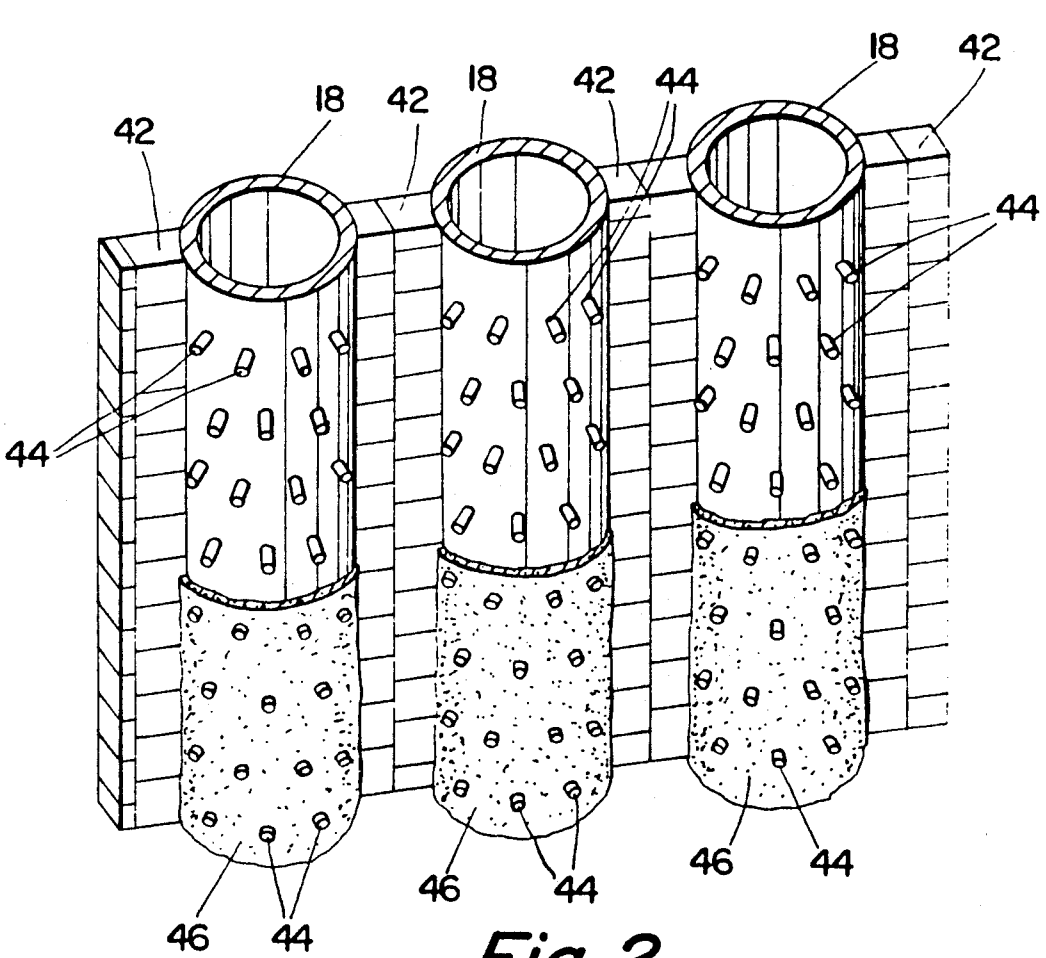
FIG. 2 depicts a section of one of the enclosure walls of the FIG. 1 recovery boiler.

FIG. 2 shows a section of one of the enclosure 14 walls 16, particularly a section within the lower furnace portion 20. As noted above, the wall 16 is a waterwall comprising carbon steel water-carrying tubes 18 for limiting the temperature of the wall 16 and for usefully generating steam. Depending upon the design of the particular recovery boiler 10, and the particular position within the recovery boiler 10, the water-carrying tubes 18 may be spaced from each other. In the particular construction depicted in FIG. 2, the water-carrying tubes are separated by webs 42, which happen to be illustrated as refractory brick. The present invention, however, is not concerned with such constructional details, and it will be appreciated that there are a number of conventional alternatives. Typically, rows of flat studs extend between boiler tubes, resembling slotted flanges. Identical rows of flat studs may extend from each of two adjacent tubes to meet, or a row of flat studs may extend from one tube only all the way to an adjacent tube. Individual flat studs are employed to define the webs, rather than solid flanges, in order to minimize thermal stresses. In other sections of the recovery boiler, the water-carrying tubes 18 may be closely adjacent, and essentially touching.

The surfaces of the water-carrying tubes 18 facing the interior of the recovery boiler 10 have studs 44 attached, as by welding. In accordance with the invention, at least some of the studs 44 are composite studs. These studs 44 serve the various purposed discussed at length hereinabove, including the purpose of anchoring a frozen smelt layer, represented at 46, to protect the water-carrying tubes 18 from direct contact with molten smelt. The studs 44 also in general aid heat exchange, and accommodate a temperature differential between molten smelt and the water-carrying tubes 18.

Figure 3:
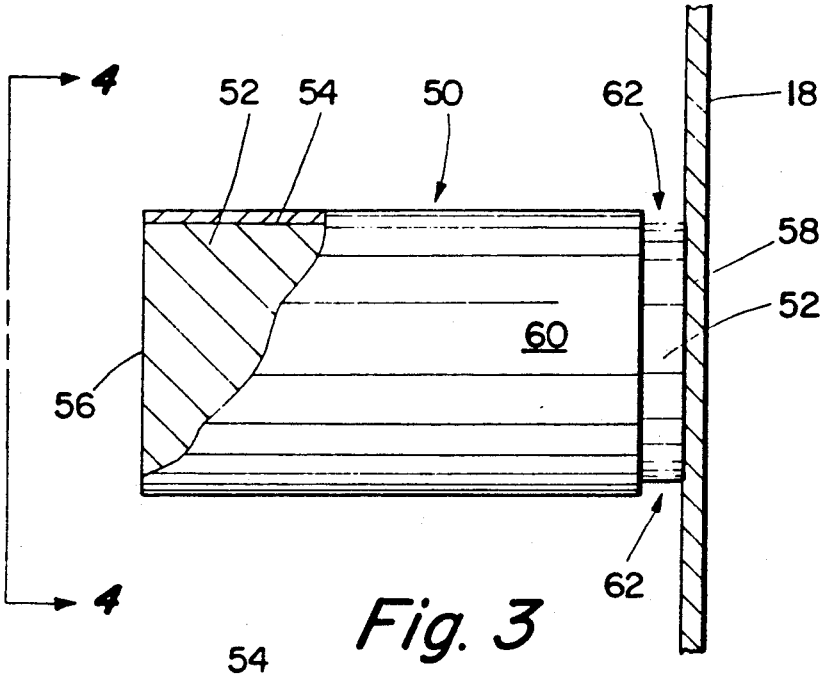
FIG. 3 is a side elevational view, partly in section, of a composite stud of the invention attached to a water tube.
Figure 4:
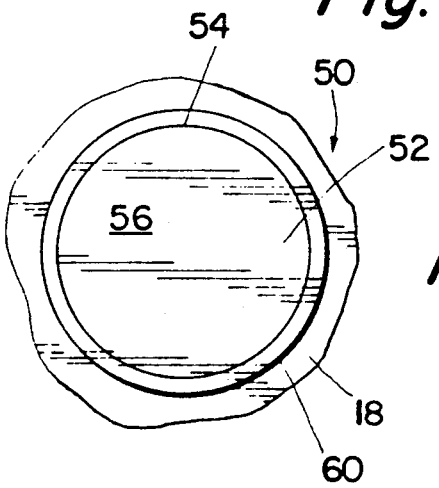
FIG. 4 is an end view of a composite stud of the invention, taken along line 4—4 of FIG. 3.

FIGS. 3 and 4 show in greater detail a composite stud 50 in accordance with the invention. The composite stud 50 includes a solid cylindrical core 52 having a cylindrical surface 54, an exposed tip or end surface 56, and a stud base or attachment end 58. The core 52 is of a material having thermal conductivity sufficient to provide proper heat transfer to the boiler tube 18 during operation. By way of example, and not limitation, the core 52 may comprise low carbon steel.

Surrounding the cylindrical surface 54 of the core 52 is a cylindrical sleeve 60 of a material resistant to destructive conditions within the boiler 10 during operation, such as high temperature chemical attack and abrasion. By way of example, and not limitation, the cylindrical sleeve 60 may comprise stainless steel. Other examples include niobium and titanium.

The stud attachment end 58 is shown attached to the wall of a water-carrying tube 18, shown in section in FIG. 3. A typical stud diameter is 3/8 inch (0.95 cm) to ½ inch (1.27 cm). A typical stud length is ¾ inch (1.91 cm). Although not shown in FIG. 3, typically in the vicinity of the interface between the attachment end 58 and the wall of the tube 18 there is an annular blob of steel resulting from the solidification of molten steel immediately following the electric arc welding process by which the stud 50 is attached to the wall of the tube 18.

Preferably, in order to prevent the melting of the sleeve 60 material during the electric arc welding process, the sleeve 60 does not extend all the way to the stud base or attachment end 58. Rather, the sleeve 60 is slightly shorter than the overall stud 50 such that there is an axial gap 62 of approximately 0.1 inch (3.0 mm). If such melting of the exemplary stainless steel sleeve 60 material were to occur during welding to the carbon steel tube 18, then an alloy having unpredictable characteristics would be formed, with potential adverse mechanical and other effects on the welded area, for example brittleness. Significantly, the absence of sleeve 60 protection for the core 52 of the stud 50 at the gap 62 does not adversely affect stud wear because, as noted above, stud temperature near the base or attachment end 58 is much lower than at the tip end 56. Thus significant corrosion does not occur in the gap 62 for the same reasons the tube 18 is protected by the studs as discussed at length hereinabove.

Figure 5:
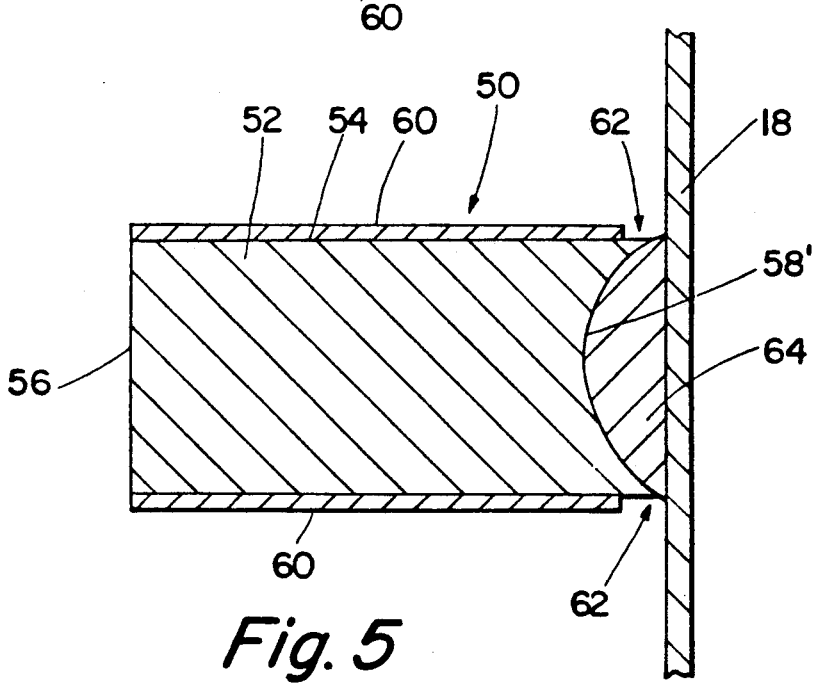
FIG. 5 is a cross-sectional side view of a composite stud of the invention attached to a nubbin of a worn stud.

As illustrated in FIG. 5, the composite stud 50 is not necessarily attached directly to the wall of the water-carrying tube 18. Rather, the composite stud 50 may be indirectly attached to the tube 18 by being directly attached to a nubbin 64 of a consumed or worn stud, which may be a conventional carbon steel stud. To facilitate attachment to the curved surface of the nubbin 64, in FIG. 5 the composite stud 50 preferably has its attachment end 58, preconfigured in a concave configuration to match the curved surface of the nubbin 64. To this end, a selection of replacement composite studs 50 may be provided having a variety of concave preconfigurations to accommodate a variety of conical configurations assumed by worn studs, depending on their particular location within the furnace 20. Alternatively, a grinding operation may be performed to flatten the nubbin 64 prior to welding of the composite stud. In either case, electric arc welding is employed to attach the composite stud 50. As in FIG. 3, the sleeve 60 does not extend all the way to the base or attachment end 58', leaving an axial gap 62 of approximately 0.1 inch (3.0 mm) to prevent melting of the stainless steel 60 material and resultant alloying with low carbon steel.

The thickness of the sleeve 60 is selected to adequately protect the cylindrical surface 54 of the carbon steel core 52, while not unduly limiting heat transfer. (Stainless steel has only one-fourth the thermal conductivity of carbon steel.) In a recovery boiler application, and with an exemplary stainless steel sleeve 60, a sleeve thickness in the order of 0.02 inches (0.5 mm) has been found suitable. Different thicknesses may be determined by experimentation for other applications of the composite studs.

Typically, the core 52 comprises low carbon steel specified as ASTM 1010 to 1020, while the sleeve 60 comprises stainless steel specified as AISI 304.

The composite studs 50 of the invention can be manufactured by extruding continuous lengths of stainless steel-clad carbon steel core material, and then cutting to the short lengths required. Alternatively, stainless steel sleeves 60 and carbon steel cores 52 may be made separately, and then pressed together. Inasmuch as the thermal coefficient of expansion of stainless steel is less than that of carbon steel, the stainless steel sleeve 60 becomes more tightly fitted to the carbon steel core 52 of the composite stud 50 as the boiler 10 heats up during operation.

As noted hereinabove, one of the advantages of the composite studs 50 of the invention is that they maintain their cylindrical shape even as they wear, for improved anchoring of the FIG. 2 frozen smelt layer 34.

Figure 6A:
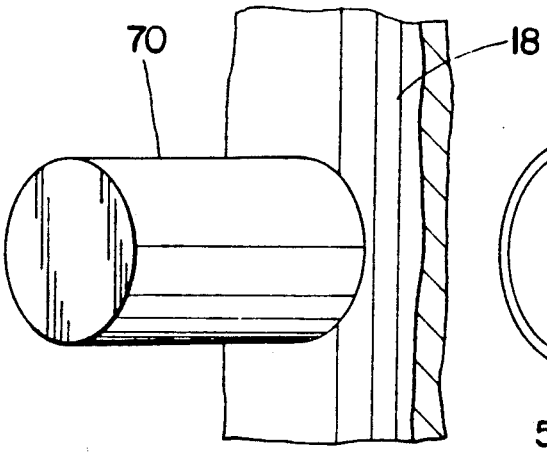
Fig. 6A PRIOR ART
FIG. 6A depicts a prior art carbon steel stud when new.
Figure 6B:
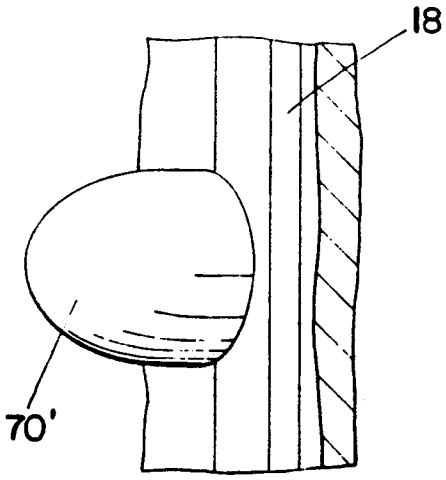
Fig. 6B PRIOR ART
FIG. 6B depicts a worn prior art carbon steel stud.

To illustrate, FIGS. 6A and 6B are "before" and "after" depictions of a prior art ordinary carbon steel stud 70 when initially installed (FIG. 6A) and as a worn stud 70' (FIG. 6B). As may be seen in FIG. 6B, the prior art studs 70 rapidly assume a rounded or conical shape. This shape represents a balance or equilibrium between incoming heat and transferred heat such that the surface temperature over the extent of the worn stub 70' is relatively constant. The particular configuration will vary depending upon particular location within the furnace 20.

Figure 7A:
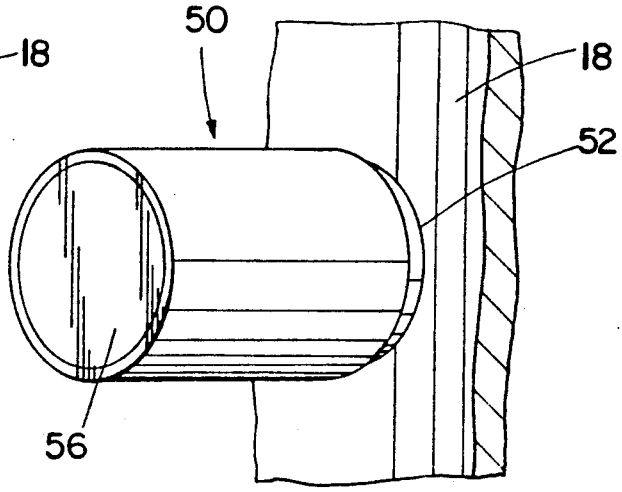
FIG. 7A, which may be contrasted with FIG. 6A, depicts a composite stud of the invention when new.
Figure 7B:
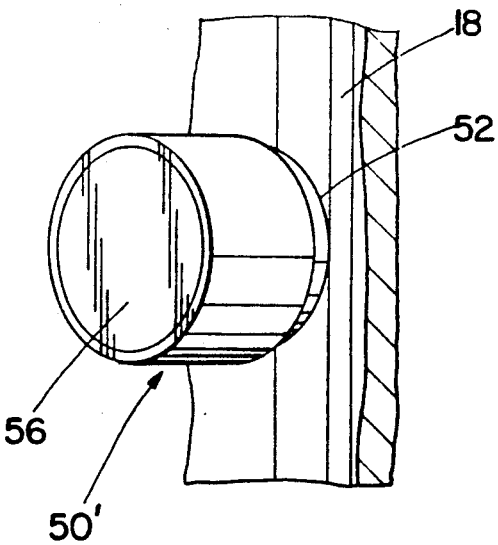
FIG. 7B, which may be contrasted with FIG. 6B, depicts a worn composite stud of the invention.

In sharp contrast are FIGS. 7A and 7B which depict the wearing characteristic of a composite stud 50 of the invention (FIG. 7A), which wears to the configuration 50' of FIG. 7B. As may be seen, the FIG. 7B worn stud 50' maintains its cylindrical shape, with a flat tip or end surface 56, for greatly enhanced retention of the frozen smelt layer 46 (FIG. 2). Thus, not only do composite studs 50 wear at a slower rate compared to conventional carbon steel studs 70, even when partially worn to the same reduced length the composite studs 50 of the invention are better able to maintain a frozen smelt layer for tube corrosion protection.

It will be appreciated that the composite studs of the invention can be employed in a variety of manners. As discussed above particularly with reference to FIG. 5, composite studs can be used in the repair of an existing boiler to replace worn studs. The replaced worn studs can either be conventional carbon steel studs, or worn composite studs. Stud replacement can be selective within a given boiler.

Composite studs in accordance with the invention can also be employed in the manufacture of new boilers. In the manufacture of new boilers, studs can be welded to tubes which are then assembled into panels, or tubes can be assembled into panels and the studs then welded. A typical panel includes six tubes, as a six-tube panel is of a size which can be handled.

Similarly, an existing boiler can be repaired by either partial or partial re-tubing, and composite studs can be welded to the tubes either before or after individual tubes are assembled into panels.

In view of the foregoing, it will be appreciated that the present invention provides an improved stud construction, particularly for recovery boilers, which provides a much longer active life, provides better anchoring of a protective frozen smelt layer even as the studs wear, and allows valuable information regarding operating conditions within the boiler to be obtained by observing the stud wear which does occur. Moreover, the composite studs of the invention are compatible with conventional studs, so that a transition to composite studs can be approached in a gradual manner, addressing first the most critical areas where wear occurs rapidly.

While specific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A boiler tube stud of composite construction comprising:

a solid cylindrical core of a metal having thermal conductivity sufficient to provide proper heat transfer to a boiler tube during operation, said core having a cylindrical surface, an exposed end surface, and an attachment end; and a cylindrical sleeve of a different metal resistant to destructive conditions within a boiler during operation surrounding said cylindrical surface of said core.

2. A boiler tube stud in accordance with claim 1, wherein said cylindrical sleeve does not extend all the way to said attachment end such that an axial gap is defined where said sleeve does not cover said cylindrical surface of said core whereby melting of said sleeve is avoided when said stud is welded to a boiler tube.

3. A boiler tube stud in accordance with claim 1, wherein said core comprises low carbon steel.

4. A boiler tube stud in accordance with claim 1, wherein said cylindrical sleeve comprises stainless steel.

5. A boiler tube stud in accordance with claim 3, wherein said cylindrical sleeve comprises stainless steel.

6. A boiler tube stud in accordance with claim 1, wherein said core comprises copper.

7. A boiler tube stud in accordance with claim 1, wherein said cylindrical sleeve comprises niobium.

8. A boiler tube stud in accordance with claim 1, wherein said cylindrical sleeve comprises titanium.

9. A boiler tube stud in accordance with claim 1, wherein said sleeve has a thickness of approximately 0.02 inch (0.5 mm).

10. A boiler tube stud in accordance with claim 9, which is approximately 3/8 inch (0.95 cm) to ½ inch (1.27 cm) in diameter, and approximately ¾ inch (1.91 cm) in length.

11. A recovery boiler for burning black liquor in a pulp mill, said boiler comprising:

an enclosure having walls comprising carbon steel water-carrying tubes for generating steam, said enclosure including a lower furnace portion where combustion occurs;

means for introducing black liquor into said furnace portion for combustion to form waste gases and smelt; and a plurality of studs attached to said water-carrying tubes for anchoring a frozen smelt layer to protect said water-carrying tubes from direct contact with molten smelt and for accommodating a temperature differential between the molten smelt and the water-carrying tubes, at least some of said studs being of composite construction and comprising a solid cylindrical core of a metal having thermal conductivity sufficient to provide proper heat transfer to a boiler tube during operation, said core having a cylindrical surface, an exposed end surface, and an attachment end attached to one of said water-carrying tubes, and a cylindrical sleeve of a different metal resistant to destructive conditions within a boiler during operation surrounding the cylindrical surface of said core.

12. A recovery boiler in accordance with claim 11, wherein said cylindrical sleeves of said composite studs do not extend all the way to said attachment ends such that an axial gap is defined where said sleeves do not cover said cylindrical surfaces of said cores, and wherein said composite tubes are attached to said water-carrying tubes by welding, said gaps serving to avoid melting of said sleeves when said composite studs are welded to said tubes.

13. A recovery boiler in accordance with claim 11, wherein said cores of said composite studs comprise low carbon steel.

14. A recovery boiler in accordance with claim 11, wherein said cylindrical sleeves of said composite studs comprise stainless steel.

15. A recovery boiler in accordance with claim 14, wherein said cylindrical sleeves of said composite studs comprise stainless steel.

16. A recovery boiler in accordance with claim 11, wherein said cylindrical sleeves of said composite studs comprise niobium.

17. A recovery boiler in accordance with claim 11, wherein said cylindrical sleeves of said composite studs comprise titanium.

18. A recovery boiler in accordance with claim 11, wherein said studs are approximately 3/8 inch (0.95 cm) to ½ inch (1.27 cm) in diameter and approximately ¾ inch (1.91 cm) in length, with a sleeve thickness of approximately 0.02 inch (0.5 mm).

19. A method for protecting carbon steel boiler tubes in a recovery boiler, said method comprising:

providing a plurality of studs of composite construction, each composite stud including a solid cylindrical core of a metal having thermal conductivity sufficient to provide proper heat transfer to a boiler tube during operation, the core having a cylindrical surface, an exposed end surface, and an attachment end, and a cylindrical sleeve of a different metal resistant to destructive conditions within a boiler during operation surrounding the cylindrical surface of the core; and welding the attachment ends of the composite studs to the boiler tubes.

20. A method in accordance with claim 19, which comprises providing composite studs wherein the cylindrical sleeves do not extend all the way to the attachment ends such that axial gaps are defined where the sleeves do not cover the cylindrical surfaces of said core whereby melting of the sleeves is avoided when the composite studs are welded to the boiler tubes.

21. A method in accordance with claim 19, wherein the recovery boiler has a plurality of worn conventional carbon steel studs, and which method comprises welding the attachment ends of the composite studs to at least some of the worn conventional carbon steel studs.

22. A method in accordance with claim 21, which comprises welding the composite studs to worn conventional studs in areas of the recovery boiler where wear occurs most rapidly.

23. A method in accordance with claim 19, which comprises providing composite studs approximately 3/8 inch (0.95 cm) to ½ inch (1.27 cm) in diameter and approximately ¾ inch (1.91 cm) in length, with a sleeve thickness of approximately 0.02 inch (0.5 mm).

24. A method in accordance with claim 19, which comprises providing composite studs having cores of carbon steel.

25. A method in accordance with claim 19, which comprises providing composite studs having sleeves of stainless steel.

26. A method in accordance with claim 24, which comprises providing composite studs having sleeves of stainless steel.

27. A method in accordance with claim 19, which comprises providing composite studs having sleeves of niobium.

28. A method in accordance with claim 19, which comprises providing composite studs having sleeves of titanium.

* * * * *